United States Patent [19]

Lorentzen

[11] 4,196,802

[45] Apr. 8, 1980

[54] PRODUCT COOLING AND FREEZING SYSTEM

[75] Inventor: Jørgen Lorentzen, Naerum, Denmark

[73] Assignee: A/S Atlas, Ballerup, Denmark

[21] Appl. No.: 919,445

[22] Filed: Jun. 27, 1978

[30] Foreign Application Priority Data

Jun. 28, 1977 [GB] United Kingdom ..... 26904/77

[51] Int. Cl.[2] ..... B65G 37/00

[52] U.S. Cl. ..... 198/482; 62/380; 198/472; 198/580

[58] Field of Search ..... 198/466, 482, 560, 580, 198/604, 607, 796, 472; 62/380; 34/149

[56] References Cited

U.S. PATENT DOCUMENTS

| | | | |
|---|---|---|---|
| 1,123,934 | 1/1915 | Schrafft et al. | 198/607 X |
| 1,635,406 | 7/1927 | Greer | 198/604 |
| 3,371,769 | 3/1968 | Beninger | 198/466 X |
| 3,911,593 | 10/1975 | Colapinto | 34/149 X |
| 3,993,189 | 11/1976 | Khoylian et al. | 198/604 X |

FOREIGN PATENT DOCUMENTS

| | | | |
|---|---|---|---|
| 188517 | 12/1966 | U.S.S.R. | 62/380 |

*Primary Examiner*—Jeffrey V. Nase
*Attorney, Agent, or Firm*—Harold L. Stowell

[57] ABSTRACT

A system for cooling and freezing goods by cooled air is described, in which a series of large, rectangular plates carrying the goods pass over a first roller track into an ascending lift in a freezing room. The lift successively receives the plates and carries them stepwise to the top of the freezing room where the plates are carried over in a descending lift, which is operated in time with the ascending lift, and which successively deposits the plates on a second roller track for removal from the freezing room.

1 Claim, 3 Drawing Figures

PRODUCT COOLING AND FREEZING SYSTEM

Figure 1:
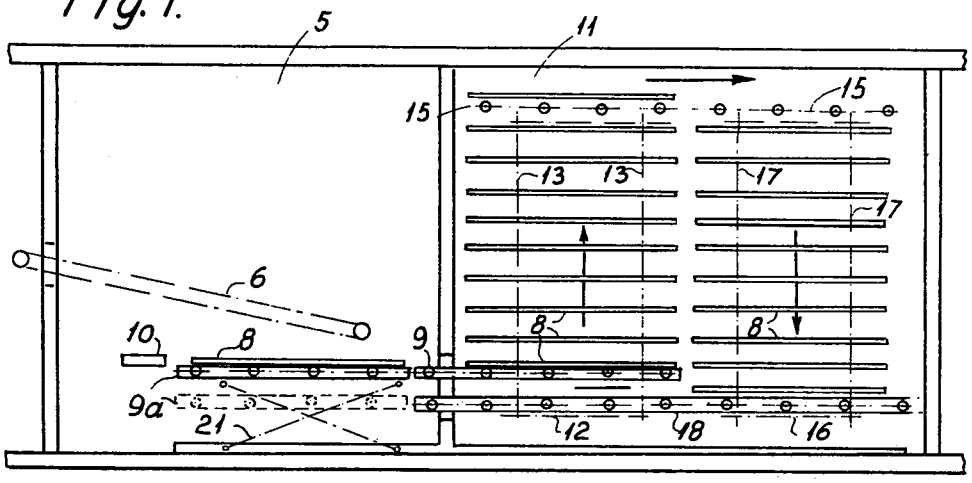

The present invention relates to a highly automated system for cooling and freezing packed and unpacked goods by means of cooled air being circulated over and around the goods.

An ever increasing demand for fresh and deep-frozen food products has necessitated the development of large scale cooling and freezing systems, which are highly automated for reducing labour costs, which are reliable in use, where the danger of contamination is greatly reduced, and where cleaning can be performed quickly and with ease.

The present system is of the kind comprising an air cooling and air distributing system, together with a product feed and product conveying mechanism within an insulated housing, and the main object of the invention is to provide a system of simplified design, which is extremely flexible in application and economic in operation with low maintenance costs.

The system comprises a series of large plates of substantially rectangular shape, preferably of stainless steel or with a stainless steel surface for carrying the goods to be frozen, a first track of rollers supporting each plate while being manually or mechanically loaded outside the freezing room, and during a forward movement of the plate on the roller track, which carries it into the freezing room, and into a first lift being stepwise operated, means for activating the lift to move one step upward subsequent to receiving a plate, a roller track at the top of the first lift serving to carry the top plate over to a second, descending lift which is operated in time with the first lift, and at the bottom of which the plates with frozen goods are successively deposited on a second track of rollers carrying the plates out of the freezing room for unloading.

In one embodiment of the system, the second track of rollers carries the plates back to the room, where the loading takes place, and means are provided to transport the plates successively back to the first track of rollers for repeated loading.

In another embodiment, the second track of rollers carries the plates to a separate unloading room, where means are provided for conveying the unloaded plates through a cleaning device and back to the loading room.

This embodiment is preferably used for unpacked goods necessitating cleaning of the plates before being used again.

In a further embodiment of the present system, the lifts consist of endless chains with spaced carriers supporting the plates at or near the four corners. The chains are activated in any known manner to move one step, whenever a loaded plate has been moved into correct position in the lift.

Instead of endless chains, the lifts can be in the form of hydraulically operated rods with spaced carriers for the plates. In that case, for example, a pair of rods are provided near each corner of a plate, of which one serves to move the plates one step upward or downward, the other then turning to bring its carriers to support the plates in the new position, after which the first one can return to its starting position.

The roller track at the top of the lifts consists of rollers which are movably suspended so as to be pushed or swung aside, when a plate is moved to top position in the first lift and to be returned to support said plate while it is conveyed over to the descending second lift.

The plates are suitably spaced in the lifts to allow for the necessary circulation of cooled air supplied from one or more cooling units with fans of known design.

Figure 2:
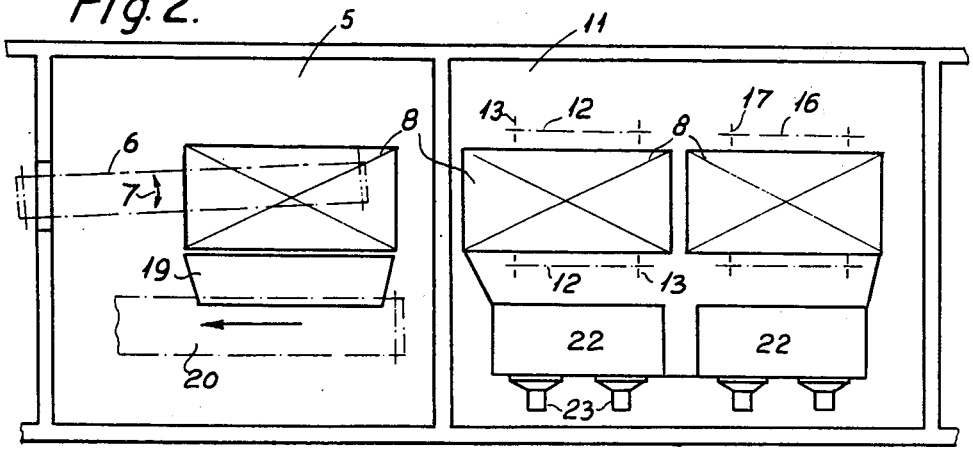

In the following, an embodiment of the cooling system of the invention and its operation will be described more detailed with reference to the accompanying diagrammatic drawings, in which FIG. 1 shows a side view of the system, FIG. 2 a plan view, and FIG. 3 an end view of the lift arrangement.

The goods to be cooled are supplied to a loading room 5 by means of a band conveyor 6, which is swingingly suspended as suggested by the double arrow 7.

The goods are deposited on a carrier plate 8 supported by a separate part 9a of a first roller track 9, the plate 8 being moved forward, during loading, by means of a hydraulic piston device 10.

Figure 3:
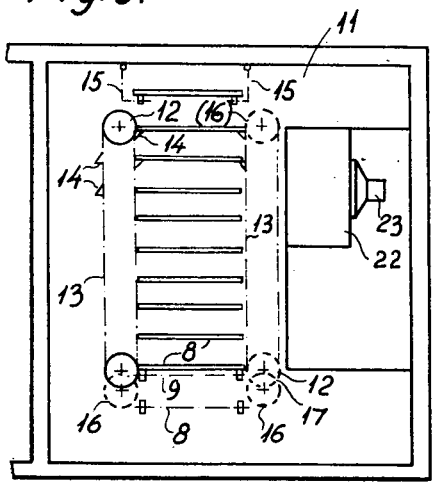

When fully loaded, the plate 8 passes into an adjoining room 11, in which the plate is deposited in a first, ascending lift 12, consisting of four vertically disposed, endless chains 13 with suitably spaced carriers 14, see FIG. 3, supporting the plates near the four corners.

Known means are provided for activating the lift 12 to move one step upward, each time a plate 8 has moved into correct position in the lift.

When the lift 12 has performed one upward step, a plate 8 arriving to the top position will be lifted onto a track 15 of movably suspended rollers, on which the plate is conveyed over to and deposited in a second, descending lift 16, consisting of endless chains 17 with spaced carriers, similar to the lift 12. The lift 16 is activated to a stepwise downward movement in time with that of the lift 12.

When the lifts 12 and 16 are filled up with plates 8 with goods to be frozen, a subsequent step in the movement will cause the bottom plate in the lift 16 to be deposited on a second roller track 18 below the first roller track 9 and returned to the loading room 5. There, the frozen goods are pushed off onto a slide 19 deposing them on a band conveyor 20 carrying them to a (not shown) store.

The part of the roller track 18 supporting the plate while being unloaded is in fact the separate part 9a of the roller track 9. The part 9a is supported by a lifting device 21, by means of which it can be moved from its position as part of the roller track 9 to its position in continuation of roller track 18 and vice versa.

Thus, as soon as a fully loaded plate 8 has passed on to the lift 12, the part 9a of the roller track 9 is lowered to the position continuing roller track 18, there to receive a plate returning from the descending lift 16 for unloading and when the plate has been unloaded, the part 9a returns to its former position as part of roller track 9, thus completing the cycle of plate movement.

In the room 11, cooling units 22 with fans 23 circulate cooled air transversely through the lifts 12 and 16, the cooled air passing horizontally through the spaces between the plates 8 in the lifts to cool and freeze the goods on the plates.

Instead of using single plates, the system may be designed for a group of plates to be placed one after the other in the lifts, which would then be designed with additional endless chains with carriers to support the individual plates.

In a preferred embodiment for large size goods to be frozen, the freezing room and the refrigerator units would have sizes, allowing for filling up the lifts in the freezing room during the day and to complete the freezing during the night to avoid overtime and night work at higher labour costs.

We claim:

1. A system for cooling and freezing packed and unpacked goods with cooled air comprising:

(a) a freezing room;

(b) a goods loading room adjacent the freezing room;

(c) a series of substantially rectangular, large plates supporting the goods during passage through the freezing room;

(d) a first roller track serving to support a plate while being loaded in the loading room adjacent the freezing room;

(e) an ascending lift and a descending lift within said freezing room being adapted to move stepwise in synchronization, the said first roller track leading to the ascending lift;

(f) means for moving a loaded plate along the first track of rollers into the ascending lift, and means for activating the lifts to perform one step of movement;

(g) a roller track adapted to receive the top loaded plate from the ascending lift, carrying it over and depositing it in the descending lift;

(h) a roller track placed under said first roller track to receive the bottom plate with frozen goods from the descending lift and carry it back to the loading room for unloading; and (i) the said roller track defined in clause (h) terminated by a movable part adapted to be raised and form part of the said first roller track, thus serving to return an unloaded plate for reloading.

* * * * *